United States Patent [19]

Nakano

[11] 4,133,632

[45] Jan. 9, 1979

[54] VAPORIZING TYPE OIL BURNER

[75] Inventor: Juichi Nakano, Osaka, Japan

[73] Assignee: Daikin Kogyo Co., Ltd., Osaka, Japan

[21] Appl. No.: 781,966

[22] Filed: Mar. 28, 1977

[30] Foreign Application Priority Data

Jun. 3, 1976 [JP] Japan ..... 51-72360[U]

[51] Int. Cl.[2] ..... F23D 13/12

[52] U.S. Cl. ..... 431/328; 431/339; 431/341

[58] Field of Search ..... 431/328, 333, 331, 337, 431/338–342

[56] References Cited

U.S. PATENT DOCUMENTS

| | | | |
|---|---|---|---|
| 1,660,857 | 2/1928 | Breese | 431/333 |
| 2,065,265 | 12/1936 | Bock | 431/338 |
| 2,422,686 | 6/1947 | Laliberte | 431/328 |
| 2,542,729 | 2/1951 | Thomson | 431/338 |
| 2,638,160 | 5/1953 | Thomson | 431/333 |
| 3,635,651 | 1/1972 | Desty | 431/328 |
| 3,723,052 | 3/1973 | Nakashima et al. | 431/339 |
| 3,947,227 | 3/1976 | Granger et al. | 431/328 |

*Primary Examiner*—Carroll B. Dority, Jr.
*Attorney, Agent, or Firm*—Cushman, Darby & Cushman

[57] ABSTRACT

A vaporizing type oil burner adaptable for use in forced flue type kerosene space heaters for household use and other heating equipment, including a fuel vaporization promoting plate made of a thin sheet of porous material and covering the entire area of the bottom of a vaporizer pot, an oil feeding device for feeding oil to the vaporizer pot which is capable of regulating the volume of oil fed to the pot, an oil diffusing device for control oil fed to the pot to the entire area of the fuel vaporization promoting plate, and a combustion air supply device. The fuel vaporization promoting plate is formed with a multitude of pores having surfaces functioning as surface means for vaporizing oil and receiving the heat of radiation generated by a flame, so that the time from initial combustion to steady state combustion following the starting of combustion can be shortened, the size of the burner can be greatly reduced, and incomplete combustion of the oil can be prevented when the burner is tilted.

5 Claims, 3 Drawing Figures

VAPORIZING TYPE OIL BURNER

BACKGROUND OF THE INVENTION

This invention relates to oil burners and more particularly to a vaporizing type oil burner adaptable for use in forced flue type kerosene space heaters for houshold use and other heating equipment.

Generally, in vaporizing type oil burners, the oil caused to flow on the bottom plate of a vaporizer pot is heated by the radiation heat of a flame in an upper portion of the vaporizer pot so as to vaporize the oil. At the time of initiation of combustion, an ignition heater is operated to ignite the oil caused to flow on the vaporizer pot bottom plate. The combustion of the oil thus ignited produces heat which causes the oil in other regions of the bottom plate to vaporize. The volume of oil thus vaporized gradually increases, and an increase in the volume of vaporized oil causes the position of combustion to gradually move upwardly. When the combustion has moved to a combustion compartment in an upper portion of the vaporizer pot and the volume of vaporized oil has stabilized, a state of steady state combustion is reached. Thus the burners can exhibit a predetermined heating performance.

Some advantages are associated with vaporizing type oil burners of the prior art. First of all, it takes a long time after ignition is taken place till steady state combustion is obtained, or their combustion rise time is long, so that they are often delayed in performing heating function to their full capacity. Secondly, it is impossible to obtain a compact size in a burner. Thirdly, severe tolerances are required for positioning the vaporizer pot bottom plate on a horizontal plane. If the vaporizer pot is positioned such that its bottom plate is inclined even slightly with respect to the horizontal combustion of the oil will take place on the lower portion of the bottom plate only and no combustion will occur on the higher portion thereof. Thus what is referred to as unbalanced combustion will take place in the vaporizer pot, with a result that lack of air supply and excess air supply will occur locally and incomplete combustion of the oil will ensue.

The reasons why oil burners of the prior art have the aforesaid disadvantages will be described in detail hereinafter. In regard to the long combustion rise time, it is known that this time depends greatly on the rate of increase in the volume of vaporized oil in relation to the time elapsing after initiation of combustion. Generally, the volume of vaporized oil in a vaporizer pot is related to the oil vaporizing area, the temperature of oil, the temperature and humidity of air for combustion fed to the interior of the vaporizer pot, the volume of oil fed to the vaporizer pot, or the like. When operation of the burner is started, the volume of supplied oil is generally equal to the volume of oil supplied to the vaporizer pot at the time of steady state combustion. The oil vaporizing surface is planar and the area thereof is equal to that of the bottom plate of the vaporizer pot.

For a little while after initiation of combustion, the temperature in the vaporizer pot is low and the volume of burned oil is small, so that the oil fed to the bottom plate of the vaporizer pot is low in temperature and the volume of vaporized oil is much smaller than when the oil burns in steady state combustion. Consequently, the volume of fed oil is greater than the volume of vaporized oil, and excess oil collects on the surface of the bottom plate to form an oil film thereon. Owing to an increase in the thermal capacity of the oil film, difficulty is encountered in accelerating the rise in the temperature of oil, and accordingly the rate of an increase in the volume of vaporized oil and the rate of an increase in the burned oil become small. Thus, it takes a long time before the state of steady state combustion is reached and hence the combustion rise time is long.

It is impossible to obtain a compact size in an oil burner for the reason that the area of the bottom plate of the vaporizer pot is the oil vaporization area at the time the operation of a burner is started, so that it is impossible to reduce this area. That is, if this area were reduced, the combustion rise time would become longer, and since the oil temperature does not rise at a stretch, the oil would undergo thermal decomposition and become tar-like. Thus the oil would not only burn in incomplete combustion but also take time before it burns satisfactorily to achieve stable heating effects.

The reason why severe tolerances are required for positioning the bottom plate of the vaporizer pot is as follows. If the bottom plate were tilting, the oil caused to flow thereon would collect in the lower portion of the bottom plate and would not flow to the higher portion thereof. Meanwhile the air for combustion is distributed such that it matches uniform spreading of the oil. Therefore, if unbalanced distribution of the oil occurred as aforesaid, there would arise the lack of air for combustion in the portion of the bottom plate on which the oil has collected. This would lead to unbalanced combustion of the oil due to the lack of air, so that soot would be produced and the stream of air current would be disturbed. This would further increase the tendency of incomplete combustion.

SUMMARY OF THE INVENTION

An object of the present invention is to provide a novel vaporizing type oil burner which can obviate all the aforesaid disadvantages of the prior art oil burners of the type described, that is in which the time for initial combustion to steady state combustion is shortened, the size of the burner is compact and incomplete combustion of the oil when the burner is tilted is prevented.

According to the present invention, there is provided a vaporizing type oil burner comprising a fuel vaporization promoting plate made of a thin sheet of porous material which is permeated with oil by the capillary action in use so that the oil will burn thereon, the oil being maintained in a form of thin layer on the surface of pores of the fuel vaporization promoting plate to increase the flaming speed and prevent local collection of the oil at the time the oil is ignited. The fuel vaporization promoting plate is permeated with oil in its entire area and the pores of the plate function as surface means for vaporizing oil and receiving heat of radiation of a flame, so that the area of the entire surface serving as means for vaporizing oil and receiving heat of radiation of a flame is increased, thereby promoting vaporization of the oil before combustion reaches steady state combustion. This offers the advantages of reducing the combustion rise time and enabling a compact size to be obtained in a burner of the type described. The arrangement that the oil is caused to permeate the fuel vaporization promoting plate of porous material by the capillary action is effective to eliminate the disadvantage of the burners of the prior art that tilting of the burner results in unbalanced combustion of the oil.

Another object of the invention is to provide a vaporizing type oil burner comprising an oil feeding device including an oil feed pipe opening on the surface of the bottom of a vaporizer pot on which the fuel vaporization promoting plate is located, the oil feeding device being capable of controlling the quantity of the oil supplied through the oil feed pipe, and an oil diffusing device including at least one oil diffusing passage formed in a space defined between at least one upwardly directed inclined portion, formed by continuously raising away from the surface of the bottom of the vaporizer pot a portion of the fuel vaporization promoting plate which covers a marginal portion of the bottom of the pot, and the surface of the bottom of the pot for causing oil to flow therethrough by natural flow action to the marginal portion of the bottom of the vaporizer pot so as to cause the oil to be diffused to the entire area of the fuel vaporization promoting plate by utilizing the passage.

By this arrangement, it is possible to positively prevent local collection of the oil and to reduce the combustion rise time. Also, the provision of the upwardly directed inclined portions to the fuel vaporization promoting plate enables the area of the oil vaporizing and flame radiation heat receiving surfaces to be increased as compared with those in a planar fuel vaporization promoting plate, thereby permitting the combustion rise time and the size of the burner to be reduced. The provision of the upwardly directed inclined portions offers a further advantage in that, even if oil collects locally on the bottom of the vaporizer pot and the fuel vaporization promoting plate is locally immersed in the oil due to a delay in ignition of the oil with an attendant reduction in the flaming speed of the portion of the plate immersed in the oil, the upwardly directed inclined portions are suitably permeated with the oil and combustion takes place thereon, so that such portions act as intermediary between various portions of the fuel vaporization promoting plate in burning the oil. Thus a lowering in flaming speed and a delay in the combustion rise time can be prevented.

Another object of the invention is to enable, in a vaporizing type oil burner wherein at least one upwardly directed inclined portion is formed in the fuel vaporization promoting plate and the space beneath the inclined portion is used as an oil passage for supplying oil uniformly and in good quantity by natural flow action and capillary action from the oil passage to other portion of the fuel vaporization promoting plate than the inclined portion at the time of steady state combustion, the oil to be uniformly evaporated by means of the vaporization promoting plate and to permit evaporated oil to mix uniformly with primary air of combustion throughout the space of the vaporizer pot, whereby the oil in a gaseous state can be completely combusted.

According to another feature of the embodiment, the vaporizer pot is made of sheet metal and rectangular in horizontal cross section and comprises opposed and parallel front and rear walls which are formed in corresponding positions with inwardly projecting constricted parts extending longitudinally of the vaporizer pot. The air for combustion is introduced from outside such constricted parts of the front and rear walls, and a space in the vaporizer pot interposed between the upper and lower constricted parts of the front and rear walls serves as a mixing compartment when the burner operates on high fires and as a combustion compartment when the burner operates on low fires. The constricted parts of the front and rear walls are cooled at their outer sides by the air for combustion to prevent a rise in temperature thereof, so that occurrence of local incomplete combustion can be prevented. In conventional burners of the type described, a pilot ring made of a separate sheet material has been provided inside the pot to perform the same function as the constricted parts of the front and rear walls. This pilot ring has had the disadvantage of the being short in service life because it easily gets red hot and is oxidized. The provision of the constricted parts to the front and rear walls of the pot can obviate this disadvantage of the prior art.

According to still another feature of the embodiment, a vertical wall is located on the central line of the fuel vaporization promoting plate and oriented longitudinally of the vaporizer pot, wherein primary air for combustion is introduced through the lower constricted parts of the front and rear walls of the pot having the upper and lower constricted parts and blown onto the vertical wall, the primary air thus blown onto the vertical wall being diffused by the wall and brought into contact with the oil which has permeated the fuel vaporization promoting plate. This arrangement has the effect of preventing local incomplete combustion of the oil which would otherwise occur when, 30 or 40 minutes before the oil tank runs out of oil, primary air for combustion is blown onto the fuel vaporization promoting plate without being diffused, because at such time only a minute volume of oil is fed from the oil tank and the oil deposited on the surface of the fuel vaporization promoting plate is very small in volume.

DESCRIPTION OF THE PREFERRED EMBODIMENTS

The invention will now be described with reference to the embodiments thereof by referring to the accompanying drawings.

Figure 1:
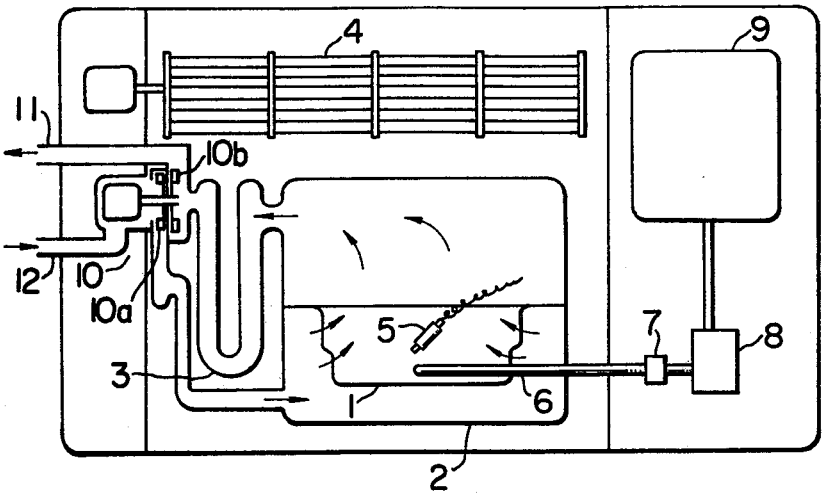
FIG. 1 is a schematic view showing the arrangement of parts in a forced flue type kerosene space heater incorporating therein an embodiment of the vaporizing type oil burner conforming to the present invention.

FIG. 1 shows a forced flue type kerosene space heater incorporating therein an embodiment of the invention. The heater includes a casing divided into three sections, one of such sections or central section including a combustion chamber 2 located in a lower part of the central section and housing a vaporizing type oil burner 1 conforming to the present invention, and a heat exchanger 3 connected to the combustion chamber 2 for passing combustion gases therethrough. Mounted in an upper part of the central section of the casing is a blower 4 for recycling air through a room in which the heater is mounted. The air in the room is drawn by suction through an air suction grill, not shown, of the casing, heated in the combustion chamber 2 and the heat exchanger 3, and blown out as warm air through an air outlet grill, not shown, so as to heat the space in the room. The numeral 5 designates an ignition heater, and the numeral 6 refers to an oil feed pipe. Shown at 7 is an oil regulating valve which is operative to continue or cut off the supply of oil and to effect switching between the volumes of oil fed to the combustion chamber when the burner operates at high fires and low fires. The numeral 8 designates an oil controller, the numeral 9 designates an oil tank, the numeral 10 designates a combustion fan assembly consisting of an air suction fan 10*a* and an exhaust fan 10*b*, the numeral 11 designates an exhaust duct and the numeral 12 designates an air intake duct.

Figure 2:
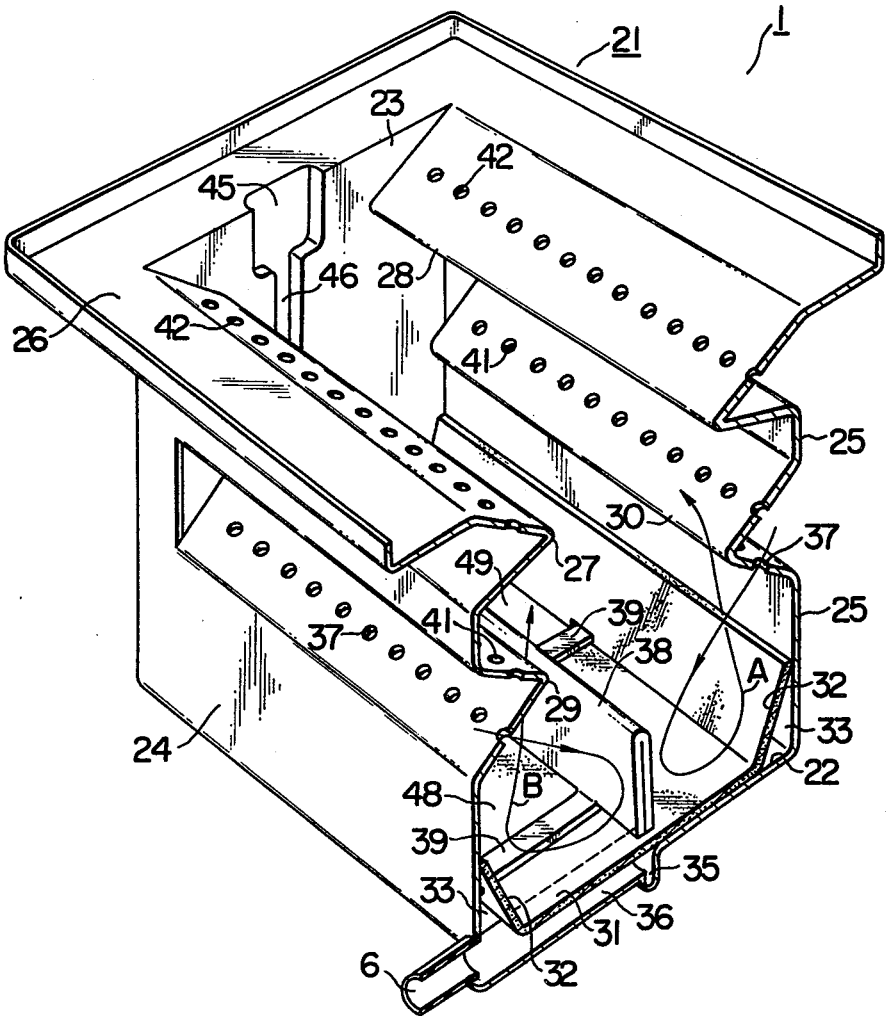
FIG. 2 is a sectional perspective view of the vaporizing type oil burner comprising one embodiment of the invention.

Referring to FIG. 2, there is shown, in a sectional perspective view, one embodiment of the vaporizing type oil burner according to the invention. As shown, the burner comprises a vaporizer pot 21 substantially rectangular in horizontal cross-section made of sheet metal and including a bottom plate 22, side walls 23, 23, front and rear walls 24 and 25, and a deck 26 formed by outwardly extending upper end portions of the rear, front and side walls.

The front and rear walls 24 and 25 are formed with upper inwardly projecting constricted parts 27 and 28 and lower inwardly projecting constricted parts 29 and 30, respectively, which are disposed in corresponding positions and extending longitudinally of the vaporizer pot 21.

Resting on the upper surface of the bottom plate 22 is a fuel vaporization promoting plate 31 made of porous metal in thin sheet form. The porous metal used for producing the fuel vaporization promoting plate 31 is such that it has a three-dimensional mesh structure wherein the pores communicate with one another and have a size suitable for causing oil to permeate the entire body of the plate 31 by the capillary action. The porous metal of the three-dimensional mesh structure may be produced as follows. For example, a foaming resin and metal powder are mixed and the resin is allowed to foam. The mixture is heated to a temperature above the decomposing temperature of the resin so as to simultaneously decompose the resin and sinter the metal powder. In another process, a gas-producing material is added to a molten aluminum alloy to cause the material to foam. In still another process, a coat of metal is applied by electroplating to the surface of a skeleton of an organic foam of a three-dimensional mesh form. In a further process, a suspension of metal powder in a fluid is applied to the surface of an organic foam skeleton and dried. Then, the temperature of the metal is gradually raised until its sintering temperature is reached, so as to carbonize and sinter the metal powder by using the organic foam as its skeleton. However, it is to be understood that the material for the fuel vaporization promoting plate 31 is not limited to such porous metal, and that any other porous material which is heat resisting and suitable for diffusing oil may be used for producing the plate 31. Such porous material may be selected from the group consisting of ceramics and stainless wool.

Referring to FIG. 2 again, the fuel vaporization promoting plate 31 has its longitudinally extending front and rear peripheral portions bent upwardly to provide upwardly directed inclined portions 32, 32, and passages 33, 33 extending from the right side wall to the left side wall are formed beneath the upwardly directed inclined portions 32, 32. Of the two passages 33, 33 which serve as oil passages, the passage 33 near the front wall 24 has a forward end of the feed oil pipe 6 connected to the central portion thereof. The aforesaid parts constitute an oil diffusing device. In the embodiment shown in FIG. 2, a groove 35 extending from the right side wall to the left side wall is formed in the central portion of the bottom plate 22, and a connecting groove 36 is also formed in the bottom plate 21 to maintain communication between the front passage 33 and the groove 35 so as to aid in diffusing oil to the fuel vaporization promoting plate 31. The grooves 35 and 36 also form part of the oil diffusing device.

Figure 3:
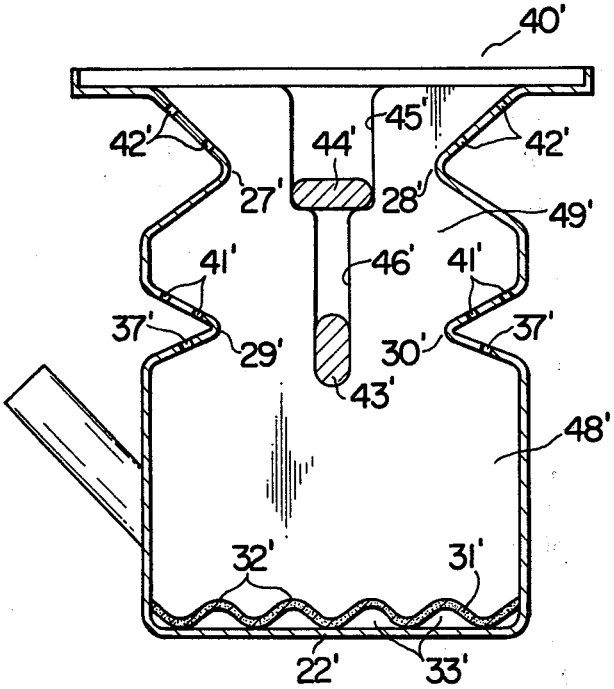
FIG. 3 is a sectional side view of a modification of the embodiment of the vaporizing type oil burner shown in FIG. 2.

In place of providing the upwardly directed inclined portions 32, 32 to the fuel vaporization promoting plate 21 as shown in FIG. 2, the fuel vaporization promoting plate 31 may be formed as a corrugated sheet 31′ as shown in FIG. 3. If this is the case, elevated areas 32′ perform the same function as the upwardly directed inclined portions 32, 32, and a space 33′ beneath each of the elevated areas serves as a passage for the oil for permitting same to diffuse. The feed oil pipe 6 may be connected at its forward end to a passage, not shown, formed at the right or left side of the fuel vaporization promoting plate 31′ and communicating with the passages 33′, 33′. In FIG. 3, like, but primed referenced characters designate parts similar to those shown in FIG. 2 and FIG. 3 description, where it would be basically repetitive is not repeated.

Referring to FIG. 1 again, the feed oil pipe 6 is connected to the oil tank 9 through the oil regulating valve 7 and oil controller 8. The feed oil pipe 6 feeds oil to the vaporizer pot 21 in a quantity which is set at a predetermined level by the oil regulating valve 7 and oil controller 8. The aforesaid parts constitute an oil feeding device.

In FIG. 2, a plurality of primary air inlet openings 37 arranged equidistantly from one another are formed in lower obliquely directed portions of the lower constricted parts 29 and 30 of the front and rear walls 24 and 25, respectively, for supplying to the fuel vaporization promoting plate 31 air for combustion from outside the front and rear walls 24 and 25 of the pot 21. A vertical plate or vertical wall 38 located in the central portion of the fuel vaporization promoting plate 31 and oriented in a longitudinal direction thereof is made of a heat resisting steel plate. Currents of air introduced through the primary air inlet openings 37 into the pot 21 are directed obliquely downwardly and impinge against the vertical wall 38, so that the air currents are diffused by the wall 38. The diffused air currents bounce back from the vertical wall 38 in turning movement as indicated by arrows A and B, so that the primary air is brought into contact with the oil that has permeated the fuel vaporization promoting plate 31. The vertical wall 38 is held in position by a plurality of supports 39 which are formed to extend generally horizontally leftwards and rightwards of the base of the plate 38 by bending the material of the wall 38 at its lower portion, the supports 39 resting on the fuel vaporization promoting plate 31 and having forward end portions which extend through the front and rear upwardly directed inclined portions 32, 32 of the plate 31 to thereby securely hold the wall 38 in position. The aforesaid parts constitute a primary combustion air supply device.

In the embodiments of the vaporizing type oil burner shown in FIG. 2, a compartment 48 below the lower constricted parts 29 and 30 of the front and rear walls 24 and 25 respectively functions as a mixing compartment wherein the primary air for combustion and the vaporized oil are mixed with each other. A space between the upper constricted parts 27 and 28 and the lower constricted parts 29 and 30 functions as a low fire combustion compartment 49 and a space above the deck 26 functions as a high fire combustion portion 40. A plurality of secondary combustion air inlet openings 41 are formed in upper obliquely directed portions of the lower constricted parts 29 and 30 of the front and rear walls 24 and 25 respectively, and a plurality of tertiary combustion air inlet ports 42 are formed in upper obliquely directed portions of the upper constricted parts 27 and 28 of the front and rear walls 24 and 25 respectively.

Again, the corresponding parts in FIG. 3 are given the same, but primed reference characters.

In FIG. 3, the numerals 43' and 44' designate burner grills which become red hot during combustion of the oil-air mixture, so that radiation heat may be applied to the oil to promote its vaporization. The numerals 45' and 46' designate grooves for fitting therein the burner grills 44' and 43' respectively. The grooves 45' and 46' are provided symmetrically at left and right side walls 23', 23'.

Operation of the vaporizing type oil burner shown in FIG. 2 in accordance with the present invention, particularly operation thereof at initial stages of combustion, will be described by referring, as an illustrative example and not by way of limiting, to the embodiment of the burner incorporated in a forced fuel type kerosene space heater shown in FIG. 1.

In operating the forced flue type kerosene space heater shown in FIG. 1, a main operating switch, not shown, is turned on to simultaneously actuate the combustion air suction fan 10*a* and exhaust fan 10*b*, open the oil regulating valve 7 and pass a current to the ignition heater 5. This permits the combustion fan assembly 10 to perform the function of introducing air from outside the room through the air intake duct 12 into the combustion chamber 2 and release exhausts from the combustion chamber through the exhaust duct 11 to outside the room. The air for combustion is blown into the vaporizer pot 21 through the air inlet openings 37, 41 and 42 formed in the front and rear walls 24 and 25 thereof. Meanwhile oil is fed from the oil tank 9 to the oil controller 8 which is constructed in a manner to keep constant the liquid level therein so as to cause a stream of oil to flow out therefrom at a constant head, so that the oil can be fed to the pot 21 through the oil regulating valve 7 and feed oil pipe 6. The oil fed to the pot 21 quickly spreads longitudinally thereof through the oil passages 33, 33 and grooves 35 and 36 and permeates, by way of the passages 33, 33 and grooves 35 and 36, the fuel vaporization promoting plate 31 by the natural flow action and capillary action so as to be diffused quickly to the entire area of the fuel vaporization promoting plate 31.

On the other hand, the ignition heater 5 is heated as a current is passed thereto and generates radiation heat, the radiation heat locally heating a portion of the oil disposed near the feed oil pipe 6 and about to spread, so that such portion of the oil is ignited. After the oil is ignited, a flame is produced and spreads as the oil diffuses. The volume of oil per unit surface area of the fuel vaporization promoting plate 31 made of porous material according to the invention is smaller than the volume of oil per unit surface area of the bottom of the pot of a conventional vaporizing type oil burner wherein oil is dropped onto the bottom of the pot. Therefore the vaporizing type oil burner according to the invention has a flaming speed which is higher than an oil spreading speed and there is no lag of flaming speed behind oil spreading speed. Thus the oil spreading through the fuel vaporization promoting plate 31 is positively vaporized by the heat of the flame. This eliminates the disadvantage of the oil collecting locally and a corresponding portion of the fuel vaporization promoting plate 31 being flooded with oil.

In this way, combustion takes place while the fuel vaporization promoting plate 31 is maintained in a state of permeation with a suitable volume of oil. This enables the pores of the fuel vaporization promoting plate 31 to perform the function of three-dimensional mesh structure characteristic of the present invention without the pores being obturated by oil. More specifically, the surface of the fuel vaporization promoting plate 31 which receives the heat of radiation generated by the flame is in the form of a complex three-dimensional surface because the surface of each pore of the three-dimensional mesh structure functions as an oil vaporizing surface and a radiation heat receiving surface. Thus, the three-dimensional surface of the plate 31 according to the invention is markedly larger in area than the planar surface of the bottom of the pot of a conventional vaporizing type oil burner, and this in turn greatly increases the oil vaporizing area.

Thus, in the vaporizing type oil burner according to the invention, the area of the surface which receives radiation heat of the flame and the area of the surface for vaporizing oil are greatly increased. By virtue of this feature, the volume of oil which vaporizes increases at once as soon as combustion is initiated and this in turn immediately increases the volume of oil which burns. Thus the oil has its temperature raised at once, which further increases the volume of oil that vaporizes. These phenomena act in chain reaction, with the result that the total volume of oil which vaporizes is markedly increased immediately after initiation of combustion. Since the temperature of oil is raised to a high level at once, no tar-like substances are produced due to thermal decomposition of oil. This eliminates the disadvantage of the pores of the fuel vaporization promoting plate 31 being clogged with tar-like substances. As a result, the combustion rise time from initiation of combustion to the attainment of steady state combustion can be markedly shortened.

The provision of the upwardly directed inclined portions 32, 32 to the fuel vaporization promoting plate 31 not only has the effect of providing oil passages but also has the effect of increasing the area of the surface for receiving radiation heat of the flame and the area of the surface for vaporizing oil, thereby further shortening the combustion rise time.

By virtue of the aforesaid features, the combustion rise time of the vaporizing type oil burner according to the invention has been reduced to 3 to 4 minutes as compared with 8 minutes of conventional oil burners of the same type.

As aforesaid, in the vaporizing type oil burner according to the invention, oil diffuses the fuel vaporization promoting plate 31 by the capillary action. Therefore, slanting of the burner with respect to the horizontal exerts substantially no influences if the angle of inclination is 2 to 3 degrees.

In the present invention, it is essential that the pores formed in the fuel vaporization promoting plate 31 are not filled with oil to a maximum, in order that the end of reducing the combustion rise time can be attained. If the pores are full of oil, the surfaces of the pores could not contribute to the increase in the area of the surface of the plate which receives the radiation heat of the flame and the area of the surface of the plate for vaporizing oil. Thus these surfaces would become substantially equal in area to the corresponding surfaces of conventional vaporizing type oil burner.

To attain this end, it is necessary, first of all, to select a suitable porous material for fabricating the vaporization promoting plate 31 so that the oil diffusing speed can be increased and local collection of oil can be avoided. Preferably, a thin sheet of porous metallic material used for fabricating the plate 31 has a large specific surface area (the specific surface area is the ratio of the surface area to the apparent volume) and a small pore diameter, because the speed of oil diffusion increases and the surface areas of the pores are increased. However, if the specific surface area is too small, the pore diameter will become too small, and such pores have the disadvantage of being readily obturated by small amounts of tar-like substances or dust. The results of experiments conducted on the specific surface area and the pore diameter show that optimum values for a thin sheet of porous metal are as follows: specific surface area, 3700 $m^2/m^3$; pore diameter, 0.6 to 0.7 mm; and the number of pores, 35 to 45/1 in. In view of the fact that the maximum thickness of the pores that can receive the radiation heat of the flame is about 2.0 millimeters and that the minimum thickness of the plate 31 that can be obtained in practice is about 1.2 millimeters, the thickness of the vaporization promoting plate in the form of a thin sheet of porous metal is preferably in the range between 1.2 and 2.0 millimeters and the thickness of about 2.0 millimeters is most preferable.

Secondly, it is necessary to prevent a reduction in the flaming speed due to local collection of oil which will result from a delay in ignition of oil when operation of the burner is initiated. If a delay in ignition occurs when operation of the burner is initiated, oil will temporarily collect locally in a portion of the fuel vaporization promoting plate 31 to which oil is fed, with the result that the pores in some portion of the plate 31 will be jammed with oil. If this situation happens, the volume of oil per unit surface area of each pore will become large and consequently the thermal capacity of oil will become great. This will result in the flaming speed becoming lower than the oil diffusing speed. Thus local collection of oil will spread to the entire area of the plate 31, so that the plate 31 will be bodily immersed in the oil. In this is the case, then the surfaces of the pores cease to function as flame radiation heat receiving surfaces and oil vaporizing surfaces, so that the combustion rise time will become substantially the same as that of conventional vaporizing type oil burners. The provision of the upwardly directed inclined portions 32, 32 to the plate 31 has the effect of preventing this phenomenon. If the upwardly directed inclined portions 32, 32 are provided, such portions 32, 32 will be suitably permeated with oil and the pores therein are not jammed with oil even if the horizontal portion of the plate 31 is immersed in the oil. Thus, when the oil is ignited, the flame will first spread to the upwardly directed inclined portions 32, 32 from the oil ignition portion of the plate 31, and the flame will then spread longitudinally of the pot 21. Thus the upwardly directed inclined portions 32, 32 function as intermediary between the oil ignition portion of the plate 31 and the horizontal portion thereof with regard to spreading of the flame, with the result that it is possible to cause the flame to spread to the entire area of the fuel vaporization promoting plate 31 as the flame spreads from the upwardly directed inclined portions 32, 32 to the horizontal portion of the plate 31. It will be appreciated that the provision of the longitudinally extending upwardly directed inclined portions 32, 32 has the effect of preventing the spread of a collection of oil in a small area of the plate 31 to the entire area thereof.

Thirdly, if possible, it is desirable to reduce the volume of oil fed to the pot 21 during the combustion rise time to a level below that of the volume of oil fed thereto during steady state combustion. This avoids the possibility of collection of oil in some portion of the plate 31 and also the possibility of spreading of a local collection of oil to a collection of oil in the entire area of the plate 31. If the oil regulating valve 7 functions to swith the flow rate of the oil between a high flow rate and a low flow rate, then it is desirable to permit oil to be fed to the pot 21 in low flow rate when combustion is initiated.

Now, the process of combustion from initial combustion to steady state combustion after lapse of a predetermined time following the aforesaid initiation of combustion will be described. If combustion is allowed to continue by feeding the oil at low flow rate, the burner will operate on low fires when steady state combustion is attained. In this case, combustion takes place in the low fire combustion compartment 49, and unbalanced combustion can be avoided by virtue of the provision of the lower constricted parts 29 and 30 to the front and rear walls 24 and 25 respectively. The lower constricted parts 29 and 30 do not become red hot because they are cooled by the air for combustion flowing along their outer surfaces. Thus the lower constricted parts 29 and 30 do not have the disadvantage of becoming red hot, being oxidized and being low in service life as has been the case with the pilot ring of conventional vaporizing type oil burners.

Switching from low fire combustion to high fire combustion can be effected by switching the oil flow rate from a low flow rate to a high flow rate by means of the oil regulating valve 7. When the burner operates at low fires, the oil vaporizing area of the fuel vaporization promoting plate 31 is much greater than the oil vaporizing area thereof which is necessary for maintaining low fire combustion. The plate 31 includes surface portions of a considerable area which are not permeated with oil. However, by increasing the flow rate of oil, it is possible to increase the area of the plate 31 which is permeated with oil, thereby increasing the volume of vaporized oil. Since the volume of air supplied to the low fire combustion compartment 49 is not sufficiently to burn the vaporized oil, it remains unburned in the low fire combustion compartment 49, so that the vaporized oil flows upwardly and is mixed with air supplied through the tertiary combustion air inlet openings 42, so that the mixture of vaporized oil and air burns in the upper fire combustion portion 40 above the deck 26.

At the time of both low fire combustion and high fire combustion, the oil permeates, by natural flow action and capillary action, the flat portion of the plate 31 excepting the inclined portion thereof by way of the passages 33, 33. Thus the quantity of oil held by the plate 31 per unit volume can be readily rendered uniform and consequently the oil in a gaseous state can be mixed uniformly with primary air of combustion, thereby enabling complete combustion to be achieved.

The function of the vertical wall 38 will now be described. Primary air for combustion introduced through the primary air inlet openings 37 is not blown directly onto the fuel vaporization promoting plate 31 but blown onto central portions or portions slightly thereabove of opposite sides of the vertical wall 38 located along the central line of the plate 31 and longitudinally of the pot 21. After being caused to diffuse by the vertical wall 38, the primary air currents flow in turning motion as indicated by arrows A and B and are brought into contact with the vaporized oil to avoid local combustion. More specifically, if the oil tank 9 runs out of oil and the liquid level of the oil controller 8 is lowered, the volume of oil fed to the fuel vaporization promoting plate 31 will become very small and the volume of oil in each of the three-dimensional pores of the plate 31 will be greatly reduced. If the primary air is blown directly onto the fuel vaporization promoting plate 31 through the primary air inlet openings 37, distribution of the volume of air on the fuel vaporization promoting plate, which contains a very small volume of oil permeating it, will become unbalanced and consequently incomplete combustion will locally occur on portions of the plate 31 on which there is a large amount of air. In order to avoid this problem of incomplete combustion, the introduced air is caused to diffuse by the vertical wall 38 so as to prevent ununiform distribution of air on the plate 31, thereby preventing the occurrence of incomplete combustion.

When the burner operates in steady state combustion, the flame generates a large amount of heat and the volume of vaporized oil per unit vaporizing area of the plate 31 increases, with a result that there is a sufficiently large area for a large volume of oil to vaporize. Thus, it is generally the case that the necessary vaporization area for a vaporizing type oil burner depends essentially on combustion rise time tolerances.

Accordingly, in the present invention, it is possible to reduce the combustion rise time as aforesaid. This makes it possible to greatly reduce the area of the bottom of the vaporizer pot 21 and hence to reduce the size of the burner in the heater. The invention has the effect of contributing to a reduction in the overall size of a forced flue type kerosene space heater for household use.

I claim:

1. A vaporizing type oil burner comprising:

a vaporizer pot;

a fuel vaporization promoting plate made of a thin sheet of porous material and resting on the bottom of said vaporizer pot in a manner to cover the entire area of the bottom;

an oil feeding device comprising an oil feed pipe extending at its forward end portion thereof through a lower end of a front wall of said vaporizer pot for feeding oil to said vaporizer pot, said oil feeding device being capable of controlling the volume of oil fed to said vaporizer pot;

an oil diffusing device including at least one oil diffusing passage provided in between the bottom of the vaporizer pot and at least one upwardly directed inclined portion provided to said fuel vaporization promoting plate, said portion being continuous at least in a longitudinal direction and said feed oil pipe communicating at its forward end with said oil diffusing passage so that oil can be diffused through said oil diffusing passage to the entire area of the fuel vaporization promoting plate so that the latter plate may be permeated with oil; and a primary combustion air supply device for supplying primary air for combustion through upper portions of front and rear walls of said vaporizer pot in such a manner that the primary air for combustion is blown onto the surface of said fuel vaporization promoting plate, said fuel vaporization promoting plate being formed with a multitude of pores, with surfaces of said pores functioning as surface means for vaporizing the oil and for receiving the heat of radiation generated by a flame; and said vaporizer pot being made of a sheet metal and being rectangular in horizontal cross-sectional shape;

said front and rear walls of said vaporizer pot being formed at corresponding positions with upper and lower inwardly projecting constricted parts; and said lower constricted parts of the front and rear walls of the vaporizer pot being formed at lower obliquely directed portions thereof with primary combustion air inlet openings of said primary combustion air supply device and at upper obliquely directed portions thereof with secondary combustion air inlet openings through which secondary air is introducted into a compartment above said lower constricted parts of the front and rear walls.

2. A vaporizing type oil burner as claimed in claim 1, wherein said fuel vaporization promoting plate has mounted on its surface along its central line a vertical wall disposed longitudinally of the vaporizer pot, so that said primary air for combustion introduced through said primary combustion air inlet openings directly impinges against said vertical wall.

3. A vaporizing type oil burner comprising:

a vaporizer pot;

a fuel vaporization promoting plate formed of a thin sheet of porous metallic material of a three-dimensional mesh structure formed therein with pores of a diameter suitable for permitting oil to permeate the plate by capillary action, said fuel vaporization promoting plate being placed on the bottom of said vaporizer pot in a manner to cover the entire area thereof and having at least one upwardly directed inclined portion formed, by continuously raising away from the surface of the bottom of the vaporizer pot, a portion of said plate which covers a marginal portion of the bottom of said pot;

an oil feeding device including an oil feed pipe opening on the surface of the bottom of said vaporizer pot on which said fuel vaporization promoting plate is located, said oil feeding device being capable of controlling the quantity of oil supplied through said oil feed pipe;

an oil diffusing device including at least one oil diffusing passage formed in a space defined between said at least one upwardly directed inclined portion of said fuel vaporization promoting plate and the surface of the bottom of said vaporizer pot for causing oil to flow therethrough by natural flow action to the marginal portion of the bottom of said vaporizer pot, said oil feed pipe having a forward end disposed on said passage so as to cause the oil to be diffused to the entire area of said fuel vaporization promoting plate by utilizing said passage; and a primary combustion air supply device for supplying a space above said fuel vaporization promoting plate with primary air of combustion;

wherein the surfaces of said pores formed in said fuel vaporization promoting plate function as surface means for vaporizing the oil and receiving the heat of radiation generated by flames.

4. An oil burner as claimed in claim 3 wherein:

said vaporizer pot is formed of a sheet metal and rectangular in shape with a relatively large longitudinal dimension; said at least one upwardly directed inclined portion of said fuel vaporization promoting plate is located along a lengthwise marginal portion of the bottom of said fuel vaporizer pot; and said vaporizer pot has front and rear walls each formed therein with an upper inwardly projecting constricted part and a lower inwardly projecting constricted part disposed in two layers in such a manner that the upper and lower inwardly projecting constricted parts of the front and rear walls extend lengthwise thereof and are disposed symmetrically, said lower inwardly projecting constricted parts being formed in lower obliquely directed portions thereof with primary combustion air inlet openings of said primary combustion air supply device and in upper obliquely directed portions thereof with secondary combustion air inlet openings through which secondary air of combustion is introducted into a compartment above said lower inwardly projecting constricted parts of the front and rear walls.

5. An oil burner as claimed in claim 4, wherein:

said fuel vaporization promoting plate is formed along its lengthwise central line with a vertical wall, said primary air of combustion being adapted to impinge directly against said vertical wall.

* * * * *